US008602651B2

(12) United States Patent
Nitti

(10) Patent No.: US 8,602,651 B2
(45) **Date of Patent: *Dec. 10, 2013**

(54) SHIPPING BAG REVERSIBLE INTO A COSMETIC BAG

(75) Inventor: Robert Anthony Nitti, Appomattox, VA (US)

(73) Assignee: Boss Licensing Group, Inc., Appomattox, VA (US)

( * ) Notice: Subject to any disclaimer, the term of this patent is extended or adjusted under 35 U.S.C. 154(b) by 956 days.

This patent is subject to a terminal disclaimer.

(21) Appl. No.: 12/543,365

(22) Filed: Aug. 18, 2009

(65) Prior Publication Data

US 2009/0304310 A1 Dec. 10, 2009

Related U.S. Application Data

(63) Continuation-in-part of application No. 11/162,811, filed on Sep. 23, 2005, now Pat. No. 7,581,886.

(51) Int. Cl.
*B65D 33/16* (2006.01)

(52) U.S. Cl.
USPC ..... 383/98; 383/204; 383/209; 383/64; 383/4

(58) Field of Classification Search
USPC ..... 383/63, 64, 99, 61.3, 61.1, 203, 204, 383/207–209, 98, 4
See application file for complete search history.

(56) References Cited

U.S. PATENT DOCUMENTS 1,187,749 A * 6/1916 Lane ..... 220/9.1
1,247,164 A * 11/1917 Specht ..... 150/118
1,895,277 A * 1/1933 Crawford ..... 383/96
2,337,860 A * 12/1943 Zeitenberg ..... 190/106
2,871,900 A * 2/1959 Auditore ..... 383/6
3,109,474 A 11/1963 Levi
3,587,698 A * 6/1971 Ritter ..... 150/116
3,630,798 A 12/1971 Wicks
3,716,182 A * 2/1973 Korn ..... 383/62
3,746,066 A * 7/1973 McIntyre ..... 150/107
3,818,963 A 6/1974 Whitman
3,982,687 A * 9/1976 Auer et al. ..... 383/204
4,213,549 A * 7/1980 Hibbard ..... 224/601
4,301,849 A 11/1981 Litwack et al.
4,375,111 A * 3/1983 Hall ..... 5/419
4,674,664 A * 6/1987 Simon ..... 224/604
4,681,781 A 7/1987 Murray
4,750,609 A 6/1988 Felis
4,941,196 A * 7/1990 Edelman et al. ..... 383/5
5,047,001 A 9/1991 Willis
5,152,612 A * 10/1992 Shoemaker ..... 383/6

(Continued)

*Primary Examiner* — Jes F Pascua
*Assistant Examiner* — Peter Helvey
(74) *Attorney, Agent, or Firm* — Louis Ventre, Jr.

(57) ABSTRACT

A flexible shipping bag may be turned inside out to make a stylish cosmetic bag. Sealing flaps permit closing the flexible shipping bag. Sealing-flap top segments may be cut-off to open the flexible shipping bag and these fold into the flexible shipping bag when the flexible shipping bag is turned inside out. Cosmetic flaps are attached inside the flexible shipping bag below the sealing flaps. These invert and become visible when the flexible shipping bag is turned inside out. A zipper to close the cosmetic bag is attached to top edges of cosmetic flaps below the point where the top segment is cut off. Once the flexible shipping bag is turned inside out, the zipper is positioned below the top edge of, and inside, the cosmetic bag and the cosmetic-flap bottom edge is positioned at the top of the cosmetic bag to provide a finished edge.

2 Claims, 5 Drawing Sheets

(56) References Cited

U.S. PATENT DOCUMENTS

| | | | | | |
|---|---|---|---|---|---|
| 5,297,870 | A | * | 3/1994 | Weldon | 383/59 |
| 5,370,461 | A | | 12/1994 | Smith | |
| 5,399,020 | A | | 3/1995 | Cheng | |
| 5,490,619 | A | * | 2/1996 | Boyar | 224/153 |
| 5,653,337 | A | | 8/1997 | Cirigliano | |
| 5,670,274 | A | | 9/1997 | Forrer | |
| 5,676,466 | A | | 10/1997 | Lindenbeck | |
| 5,692,660 | A | | 12/1997 | Stewart | |
| 5,704,670 | A | * | 1/1998 | Surplus | 294/25 |
| 5,817,379 | A | | 10/1998 | Rich et al. | |
| 5,957,354 | A | * | 9/1999 | Mentken | 224/614 |
| 5,971,611 | A | * | 10/1999 | Rosengren | 383/4 |
| 6,109,440 | A | | 8/2000 | Cliff | |
| D439,040 | S | * | 3/2001 | Vazquez | D3/233 |
| 6,230,950 | B1 | * | 5/2001 | Heetman | 224/575 |
| 6,435,391 | B1 | * | 8/2002 | Vazquez | 224/656 |
| 7,106,202 | B2 | | 9/2006 | Dickinson | |
| 7,581,886 | B2 | * | 9/2009 | Nitti | 383/4 |
| 7,988,681 | B2 | * | 8/2011 | McGarity et al. | 604/317 |
| 2002/0114539 | A1 | * | 8/2002 | Strevey et al. | 383/13 |
| 2004/0058039 | A1 | * | 3/2004 | Strand et al. | 426/130 |
| 2004/0155077 | A1 | * | 8/2004 | Cullen et al. | 224/153 |
| 2006/0153477 | A1 | * | 7/2006 | Koguchi | 383/14 |
| 2007/0140599 | A1 | * | 6/2007 | Dalgleish et al. | 383/109 |
| 2008/0056622 | A1 | * | 3/2008 | Austreng et al. | 383/5 |
| 2009/0304310 | A1 | * | 12/2009 | Nitti | 383/64 |
| 2010/0209019 | A1 | * | 8/2010 | Confoy et al. | 383/4 |
| 2011/0192875 | A1 | * | 8/2011 | Nitti | 224/575 |

* cited by examiner

SHIPPING BAG REVERSIBLE INTO A COSMETIC BAG

CROSS-REFERENCE TO RELATED APPLICATIONS

This application is a continuation-in-part of application Ser. No. 11/162,811, filed 23 Sep. 2005, which is hereby incorporated by reference herein.

TECHNICAL FIELD

In the field of flexible bags used for shipping products, a shipping bag is openable by a recipient by cutting off a segment of the shipping bag. Once the contents are removed, the shipping bag may be turned inside out to provide a durable cosmetic bag with a hidden zipper for reclosing the bag. The shipping bag serves to reduce shipping waste and generate good will towards the shipper with subsequent use as a flexible cosmetic bag.

BACKGROUND ART

The present invention is a novel and unique variation of the invention disclosed in applicant's U.S. patent application Ser. No. 11/162,811 ('811 application). That invention involves a shipping bag convertible to a tote bag. Some of the features of the present invention are the same. However, the present invention is distinct over that invention by the addition of a zipper configured to be recessed below the opening and thus hidden within the cosmetic bag. In addition, the sealing flaps of the present invention have a configuration enabling them to be cut-off without affecting zipper operation on the cosmetic flaps. Finally, detailed limitations in the '811 application involving a specified fabric inside wall and handles are eliminated.

SUMMARY OF INVENTION

A flexible shipping bag, which after use for shipping an item in commerce, can be turned inside out and transformed into a re-usable cosmetic bag. The shipping bag has an open top and sealing flaps used to close the bag for shipping. The sealing flaps have an outside wall, a plastic lining on an inside wall and a top segment that may be cut off to open a sealed shipping bag. A bottom edge of the sealing flap folds into the shipping bag when the shipping bag is turned inside out, and thereby becomes invisible to an external viewer. The shipping bag has cosmetic flaps immediately below each sealing flap on the inside of the shipping bag. A zipper is attached to the top edges of the cosmetic-flaps and is configured to close the cosmetic bag by joining these cosmetic flaps together. The zipper is situated below the sealing-flap top segment so it is unaffected by cutting open the shipping bag. The cosmetic flaps are configured to invert when the shipping bag is turned inside out such that the zipper is positioned below the top edge of, and inside, the cosmetic bag, and the cosmetic-flap bottom edge is positioned at the top of the cosmetic bag.

Technical Problem

Commerce of the United States depends to a large extent on shipping products to the consumer. Whether by United States mail or by one of the contract parcel carriers, many businesses respond to orders from consumers by placing the items ordered in a box or shipping bag and sending it to the consumer. While inexpensive, a shipping bag of this kind has no value after it is employed for shipping, it immediately adds to the stream of disposable consumer garbage, and is of little value to the shipper after it is discarded.

Solution to Problem

The present invention provides a durable shipping bag that retains value in the eye of the recipient after it is received, that promotes retention and use of the bag by the recipient, and that generates good will towards the shipper either in the form of advertising for the shipper, or simply by the recipient's use of the bag.

While the prior art teaches one or another of these objects, or variations of them, none has been found to capture all of the features and limitations in a flexible shipping bag.

The present invention starts out as a durable shipping bag in the form of a flexible bag. The bag starts out with a vendor, not the recipient, and this is important because it is a means of advertising the vendor and generating good will towards the vendor.

Advantageous Effects of Invention

The invention provides a durable shipping bag that possesses greater utility than a shipping bag; that is, one that can be easily reused as a consumer product, a cosmetic bag, purse, school supply pouch, or other stylish bag, after it is employed as a shipping bag.

BRIEF DESCRIPTION OF DRAWINGS

The drawings show preferred embodiments of the invention and the reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized, and structural and operational changes may be made, without departing from the scope of the present invention.

Figure 1:
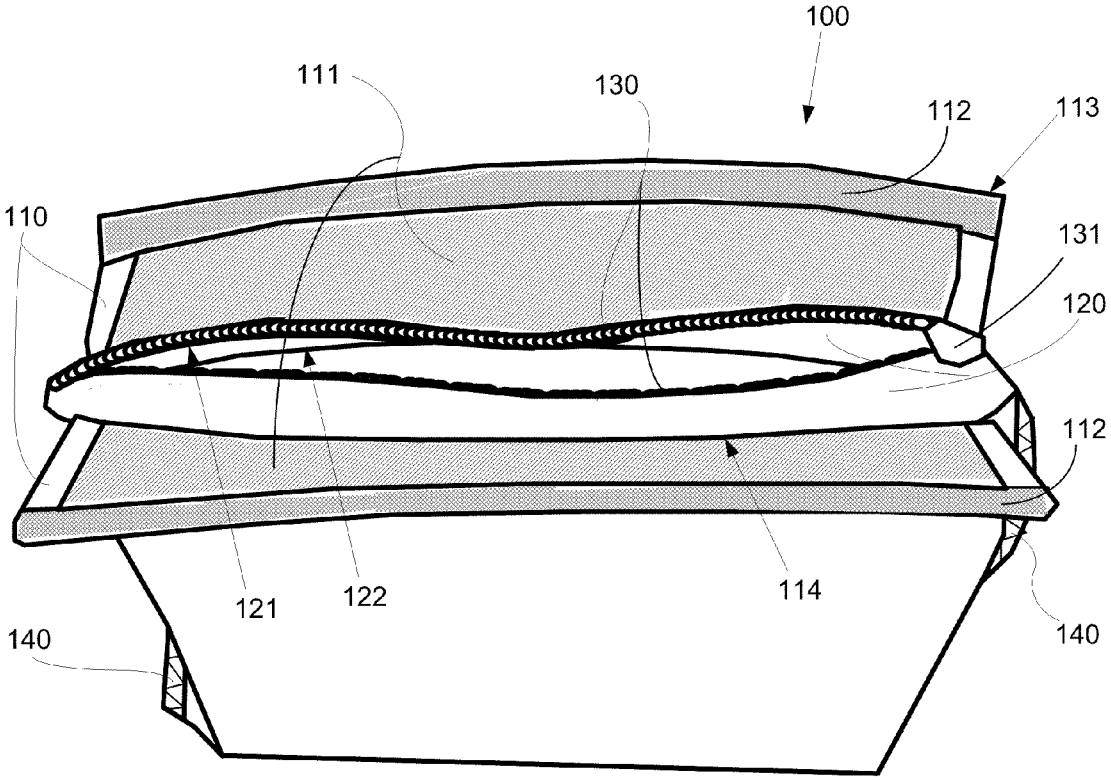
FIG. 1 is a top perspective view of the flexible shipping bag.
Figure 2:
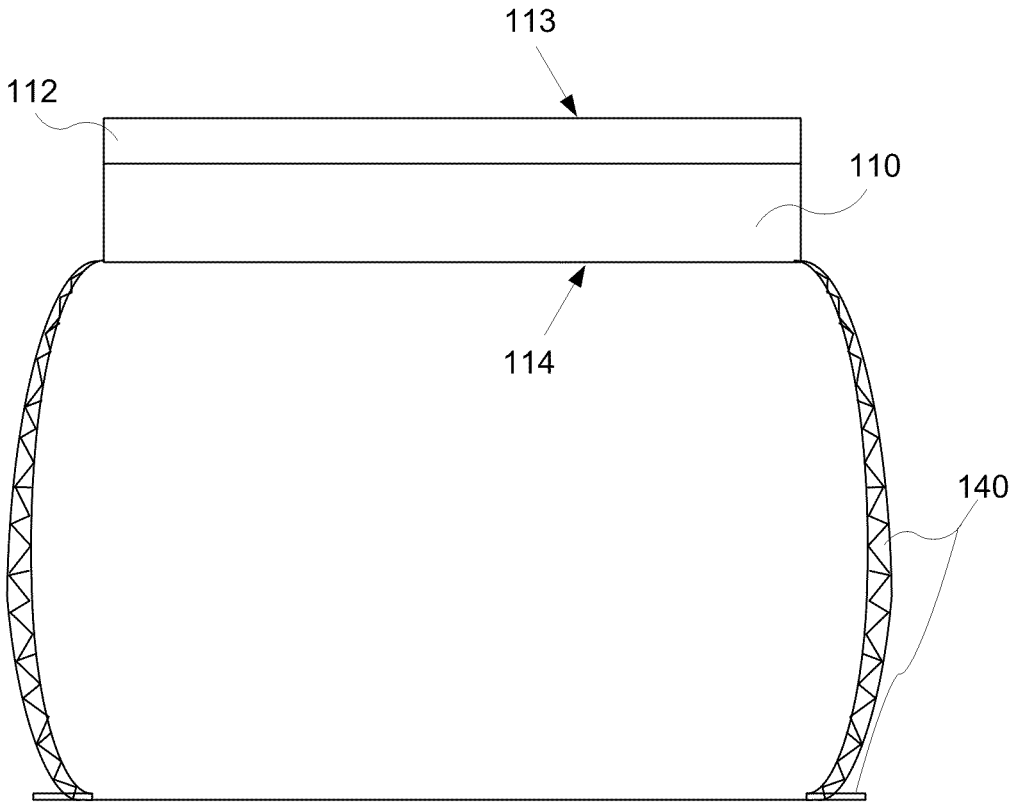
FIG. 2 is a front elevation view of the flexible shipping bag.
Figure 4:
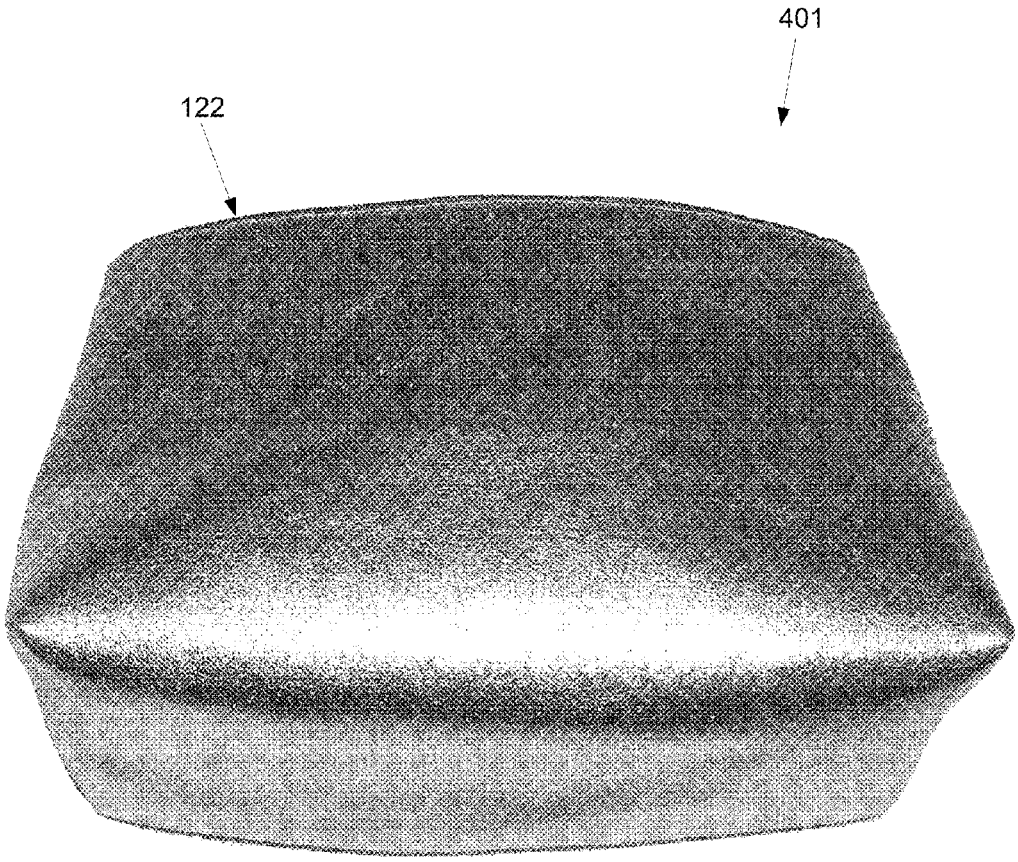
FIG. 4 is perspective view of the cosmetic bag.
Figure 5:
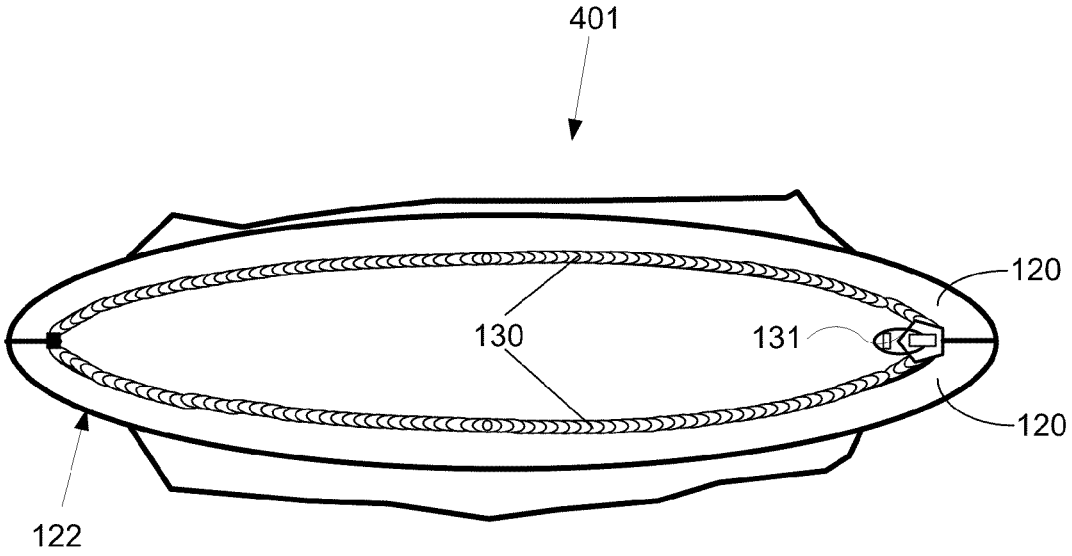
FIG. 5 is a top view of the cosmetic bag.

FIG. 1 shows a top perspective view of flexible shipping bag (100). It is shown open at the top. The flexible shipping bag (100) is configured to be turned inside out to a cosmetic bag (401) shown in FIGS. 4 and 5. FIG. 1 shows a top perspective view of the flexible shipping bag (401) and, when pulled inside out, FIGS. 4 and 5 show views of the cosmetic bag (401).

Figure 3:
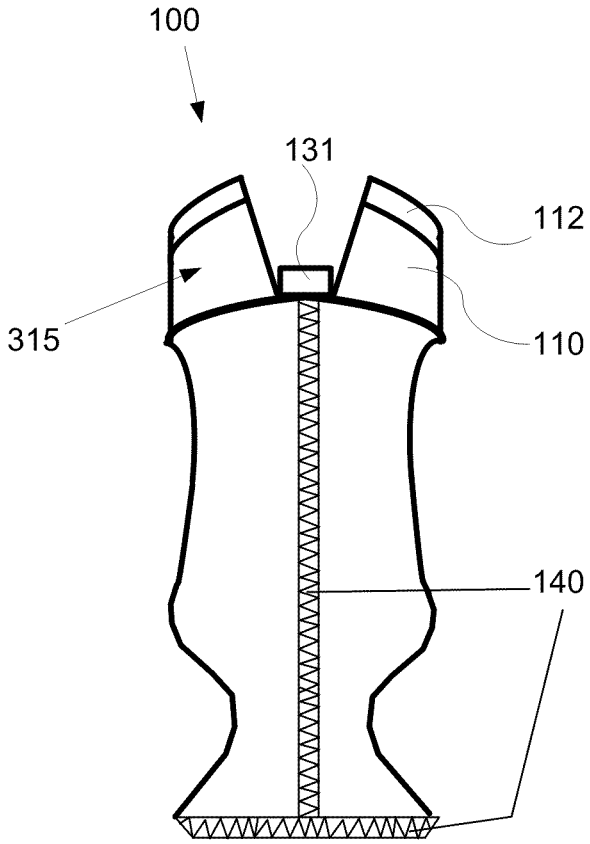
FIG. 3 is a side view of the flexible shipping bag.

The flexible shipping bag (100) is configured with a sealing flap (110), preferably two sealing flaps as shown in FIG. 1. The sealing flaps extend approximately across the opening at the top of the flexible shipping bag (100). Each sealing flap (110) has an outside wall (315) as shown in FIG. 3; a sealing-flap top segment (112); a sealing-flap top edge (113); and, a sealing-flap bottom edge (114). Preferably, the sealing flap has a plastic lining (111) on its inside wall. When present, this plastic lining (111) provides a surface amenable to attaching a peel and stick self adhesive strip to one of the sealing flaps and also promoting the seal of the front and rear flaps to each other to close the bag for shipping.

When the flexible shipping bag (100) is used for shipping, the item to be shipped is place in the flexible shipping bag (100) through the open top. The sealing flaps are then joined together with tape, glue, staples, or other means commonly used to seal a shipping bag prior to shipment. Each sealing flap (110) is configured to enable opening the flexible shipping bag (100) after shipment by cutting off the sealing-flap top segment (112). Preferably, when sealing flaps are joined together, they are mated so that the sealing-flap top segment (112) on each sealing flap (110) are approximately aligned and the recipient of the shipment can open the flexible shipping bag (100) by cutting off the top segments together using a scissor.

Each sealing-flap bottom edge (122) is configured to permit folding its sealing flap (110) into the flexible shipping bag (100) when the flexible shipping bag (100) is turned inside out, and thereby conceal the sealing flap (110) to an external viewer.

The flexible shipping bag (100) also comprises a cosmetic flap (120) for each sealing flap (110), each cosmetic flap (120) comprising a cosmetic-flap top edge (121) and cosmetic-flap bottom edge (122). The cosmetic-flap bottom edge (122) is attached inside the flexible shipping bag (100) below its corresponding sealing flap (110).

The flexible shipping bag (100) also comprises a zipper (131) attached to the cosmetic-flap top edge (121) of at least two cosmetic flaps and configured to close the cosmetic bag (401) by joining these cosmetic flaps together. A standard zipper pull (131) is part of the zipper and used to open and close the cosmetic bag (401). The zipper (130) is configured to rest below the sealing-flap top segment (112). There is preferably sufficient space below the sealing-flap top segment to the zipper to enable cutting off the sealing-flap top segment (112) without fear of also cutting the zipper (130). Thus, each cosmetic flap (120) is configured to invert when the flexible shipping bag (100) is turned inside out such that the zipper (130) is positioned below the top edge of, and inside, the cosmetic bag (401) and the cosmetic-flap bottom edge (122) is positioned at the top of the cosmetic bag (401).

When the flexible shipping bag (100) is turned inside out to the cosmetic bag (401) by pulling it inside out, any remaining sealing flap (110) is folded along its bottom edge (114) into the cosmetic bag (401) and is thereafter invisible to an external viewer. In reference to the cosmetic bag (401) shown in FIG. 5, each sealing flap (110) is below each cosmetic flap (120) adjacent to the inside wall of the cosmetic bag (401) and not visible to an external viewer.

The bag is preferably made from a single sheet cut to dimensions and the ends sewn together with stitching (140) along both sides and at the ends of the bottom of the flexible shipping bag (100). The stitching (140) is visible on the exterior of the flexible shipping bag (100). When the flexible shipping bag (100) is turned inside out to convert it to a cosmetic bag (401), the stitching (140) is inside the cosmetic bag (401) and is invisible to an external viewer.

While there has been described herein what is considered to be the preferred exemplary embodiment of the present invention, other modifications of the present invention shall be apparent to those skilled in the art from the teachings herein, and it is therefore, desired to be secured in the appended claim all such modifications as fall within the true spirit and scope of the invention. Accordingly, what is desired to be secured by Letters Patent of the United States is the invention as defined and differentiated in the claims that follow.

INDUSTRIAL APPLICABILITY

The invention has application to the shipping industry, the cosmetics industry and the women's apparel industry.

What is claimed is:

1. A flexible shipping bag having an open top and configured to be turned inside out to a flexible cosmetic bag, the flexible shipping bag comprising:

sealing flaps each comprising: an outside wall; a sealing-flap top segment; a sealing-flap top edge; and, a sealing-flap bottom edge, wherein the sealing flaps are configured to enable opening the flexible shipping bag by cutting off the sealing-flap top segment, wherein each sealing-flap bottom edge is configured to permit folding its sealing flap into the flexible shipping bag when the flexible shipping bag is turned inside out, and thereby conceal the sealing flap to an external viewer;

a cosmetic flap for each sealing flap, each cosmetic flap comprising a cosmetic-flap top edge and cosmetic-flap bottom edge, wherein each cosmetic-flap bottom edge is attached inside the flexible shipping bag below its corresponding sealing flap;

a zipper attached to the cosmetic-flap top edge of at least two cosmetic flaps and configured to close the cosmetic bag by joining these cosmetic flaps together, wherein the zipper is configured to rest below the sealing-flap top segment, and wherein the cosmetic flaps are configured to invert when the flexible shipping bag is turned inside out such that the zipper is positioned below the top edge of, and inside, the cosmetic bag and the cosmetic-flap bottom edge is positioned at the top of the cosmetic bag.

2. The flexible shipping bag of claim 1 wherein the sealing flap further comprises a plastic lining on an inside wall.

* * * * *